United States Patent [19]

Watkins et al.

[11] 3,992,889

[45] Nov. 23, 1976

[54] FLOTATION MEANS FOR SUBSEA WELL RISER

[75] Inventors: Bruce J. Watkins, Palos Verdes Estates; A. Michael Regan, Huntington Beach, both of Calif.

[73] Assignee: Regan Offshore International, Inc., Torrance, Calif.

[22] Filed: June 9, 1975

[21] Appl. No.: 585,377

[52] U.S. Cl. ..... 61/86; 61/112; 175/.6; 175/7

[51] Int. Cl.[2] ..... E21B 7/12

[58] Field of Search ..... 61/46, 69, 46.5, 72.3, 61/72.1; 175/7; 166/.5, .6; 9/8

[56] References Cited

UNITED STATES PATENTS

| | | | |
|---|---|---|---|
| 3,359,741 | 12/1967 | Nelson | 61/46 |
| 3,855,656 | 12/1974 | Blenkarn | 175/7 |
| 3,858,401 | 1/1975 | Watkins | 61/46 |

*Primary Examiner*—Jacob Shapiro
*Attorney, Agent, or Firm*—Poms, Smith, Lande & Glenny

[57] ABSTRACT

Improvements in flotation means for subsea well riser wherein the riser is run from a floating vessel and includes one or more buoyancy chambers open in the lower portions thereof to the sea and a gas injection line runs from the vessel to each of the chambers for injecting gas from a source thereof under pressure into each such chamber. The improvements include the provision of means for controlling the bleeding off of gas from within each of the chambers to reduce the buoyancy thereof thereby making the flotation of the riser completely adjustable. A check valve may be provided between the injection line and the chambers for limiting the introduction of gas into the chambers from the injection line until a predetermined pressure of the gas in the injection line is reached.

21 Claims, 8 Drawing Figures

FLOTATION MEANS FOR SUBSEA WELL RISER

BACKGROUND OF THE INVENTION

1. Field of the Invention

The invention relates to improvements in flotation means for subsea wall risers; and, more particularly, to means for making such flotation means completely adjustable.

2. Description of the Prior Art

In U.S. Pat. No. 3,858,401 to Watkins, flotation is provided for a subsea well riser conduit run between a floating vessel provided with a source of compressed gas or air and a subsea well head. Such flotation means includes a plurality of open bottom buoyancy gas receiving chambers and means for mounting them about and along the riser conduits. Air or gas conduit means connected between the source of compressed gas and each of the chambers introduces gas in selectable amounts into the chamber, displacing water entrained therein out the open bottom of the chamber to provide a selectable amount of buoyancy to the riser conduit. Gas valve means are provided at one or more of the chambers. The gas valve means include associated float means for holding the valve means open when the water level is above a predetermined level in the associated chamber and for closing the valve when the water level falls below the level to avoid loss of gas out through the open bottom of the chambers. A restricted orifice is provided between each chamber and the gas conduit means to provide a generally equal distribution of gas to each chamber from the gas conduit. The opened bottom buoyancy chamber includes an annular airtight flange formed integrally of an extending radially outward from each of a plurality of riser conduit sections and a plurality of generally cylindrical airtight shells. Mounting means mount the shells about the riser conduit in an airtight and depending relationship to an associated annular flange to thereby provide airtight top and side walls to the open bottom chambers. A centralizer is provided at the bottom of each chamber to generally maintain the desired spacing between the shells and the conduit sections. The advantages of this flotation means over prior art systems is discussed in detail in the Watkins patent. However, it is desirable that the buoyancy in each chamber be adjustable so as to render the entire system completely adjustable. No such means are disclosed in the Watkins patent.

SUMMARY OF THE INVENTION

It is an object of this invention to provide improvements in flotation means for a subsea well riser having one or more buoyancy chambers that renders the flotation means completely adjustable.

It is a further object of this invention to provide means in such flotation means for bleeding off the gas within each chamber.

There is still another object of this invention to provide means for controlling the introduction of gas into each chamber depending upon the pressure of the gas in the injection line.

These and other objects are preferably accomplished by providing aa subsea well riser wherein the riser is run from a floating vessel and includes one or more buoyancy chambers open in the lower portions thereof to the sea and a gas injection line runs from the vessel to each of the chamber for injecting gas from a source thereof under pressure into each such chamber. The improvements include the provision of means for controllably bleeding off of gas from within each of the chambers to reduce the buoyancy thereof thereby making the flotation of the riser completely adjustable. A check valve may be provided between the injection line and the chambers for limiting the introduction of gas into the chambers from the injection line until a predetermined pressure of the gas in the injection line is reached.

Detailed Description of the Preferred Embodiment

Figure 1:
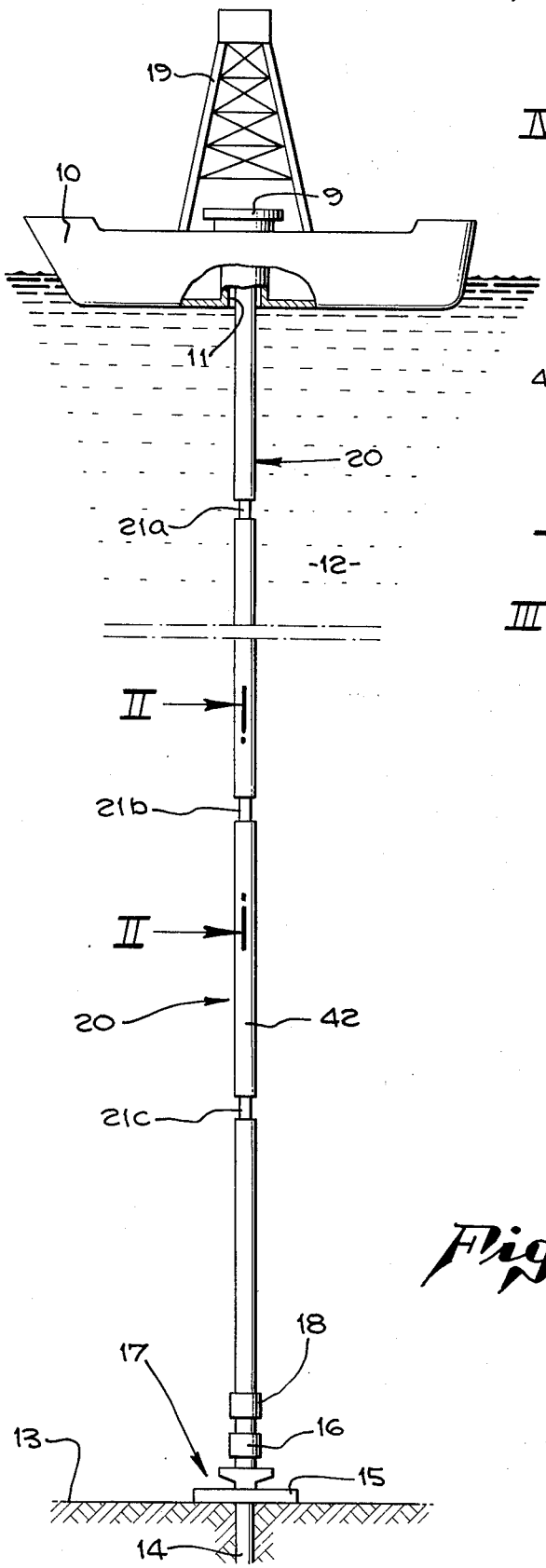
FIG. 1 is an elevation depicting a floating platform or vessel over a subsea well site or formation with guide means interconnecting the vessel and the wellhead.

A subsea well riser or conductor conduit 20 extends from a floating vessel or platform 10 through the body of water 12 to a wellhead 17. The vessel is suitably anchored on the surface of the water. The subsea well riser conduit is run from the vessel or platform of slot 11, which is below the derrick 19, to the wellhead indicated generally at 17 which is mounted on the well template 15 above the conductor pipe 14 in the formation 13. Conventional blowout preventer apparatus 16 and riser coupling apparatus 18 may be additionally provided at the wellhead.

The subsea well riser conduit 20 is formed of a plurality of conductor conduit sections 21. Conductor conduit section 21*a* is the conduit section nearest the vessel while conduit section 21*c* is nearest the wellhead. These conduit sections are generally approximately 40 to 50 feet long. It is contemplated that the riser conduit of the instant invention could be used in a drilling operation conducted at a depth of 6,000 feet below the water surface.

Figure 3:
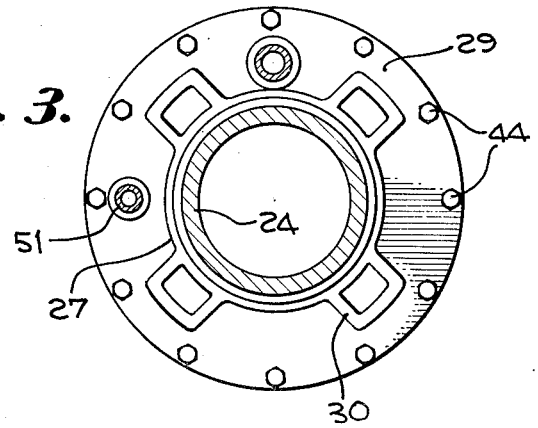
FIG. 3 is a sectional view taken along line III—III in FIG. 2.

Each conduit section has a cylindrical wall 22 having a top portion 23 and a bottom portion 24. At the end of the top of the conduit section 23 is a portion of larger inside diameter 25 which accepts the bottom portion of the conduit section mounted directly above it. O-rings 26 seal the junction of the two adjacent conduit sections. An annular section 27 is provided into which locking dogs 30 clamp (FIG. 3) to hold the adjacent conduit sections together. Bottom flange 28 and top flange 29 project radially outward from the respective bottom and top portion of each conduit section. These flanges serve to guide a pipeline 51 carrying pressurized gas whose function along with additional functions of the top flange will be discussed hereinafter.

A plurality of open bottom buoyancy air or gas receiving chambers and means for mounting them about and along said riser conduit are included in the invention. In the preferred embodiment, such chambers 40 are formed by a cylindrical shell 42 attached to the top flange 29 by mounting means 41 to form an airtight seal therebetween. Preferably, the mounting means includes a plurality of bolts arounds the periphery of flange 29 connecting the flange to the annular shell 42. Centralizer ring 43 mounted near the bottom of the shell serve to maintain the annular shell a fixed distance from the cylindrical wall of the riser conduit. The contemplated centralizer is a ring 45 with radial fins 46 extending from the outer surface of the riser conduit to the inside of the shell. To add more support to the shell, other centralizers (not shown) may be spaced along each riser conduit section. There is no seal to the bottom of the chamber and water is free to rise inside the chamber.

The chambers run almost the total length of each riser conduit section and all are substantially the same size. This aids in handling them. Because the shells are of uniform dimensions throughout their length, the cost per shell is decreased and handling is facilitated.

Figure 5:
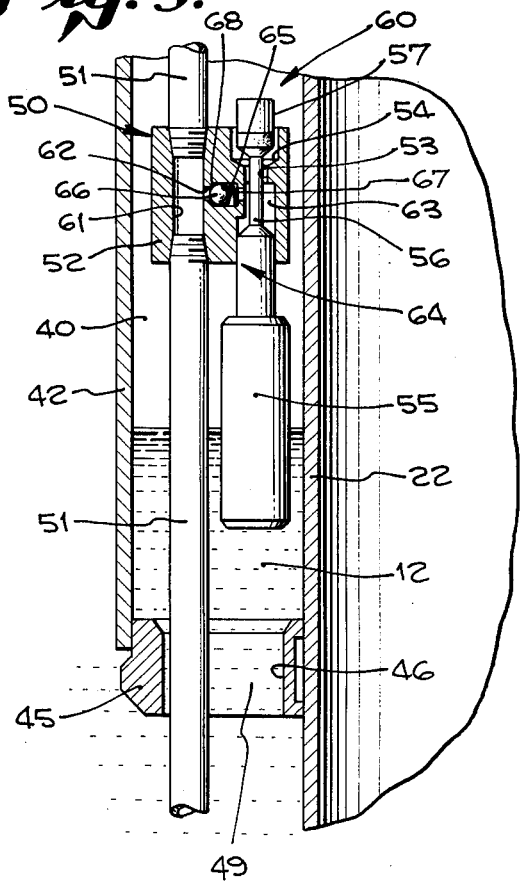
FIG. 5 is a detailed view of the gas conduit, the float, and the associated valve.

Air or gas supply means, including a gas line or gas conduit means, is connected between a source of compressed air or gas on the vessel and each chamber for introducing gas in selectable amounts into the chamber displacing water entrained therein out the open bottom of the chamber to provide a selectable amount of buoyancy to the riser conduit. In the preferred embodiment such gas supply means 50 includes a gas line or gas conduit means 51 and gas valve means 52. The gas valve means includes an associated float means 55 for holding the valve means open when the water level is above a predetermined level in the associated chamber and for closing the valve means when the water levels falls below the level to avoid loss of gas out through the open bottom of any chamber. Float means 55 (see FIG. 5) is connected by a stem or connector members 56 to a valve member 57 above the valve seat 54 so that as the level of water 12 rises within the chamber 40, float means 55 causes the valve member 57 to move upward from valve seat 55 in FIG. 5 and allow gas into the chamber. The gas will displace water 12 inside the chamber until the level of water reaches a low enough level so that float 55 is no longer supported on the water and drops a sufficient distance to close the valve seat 54 of valve 52. Therefore, even though there is more water pressure on the lowermost riser conduit sections than on the uppermost riser conduit sections, when the upper riser conduit sections fill with gas, the valve will then close and gas can flow into the chambers associated with the lower conduit sections instead of having gas leaking from the bottoms of the chambers associated with the upper conduit sections.

Additionally, a means for restricting gas flow is provided between each chamber and the gas conduit means for providing a generally equal distribution of gas from the gas conduit to the chambers. In the preferred embodiment, such means includes the provision of a restricted passage 53 formed between stem 56 and the orifice in valve seat 54. The gas flow restricting chamber balances the flow of air between the respective chambers.

The gas conduit means passes through an aperture in the top flange 29. This aperture is sealed by the seal means 59. It should be noted that seal 59 and the means 41 mounting the shell 42 to the top flange 29 must cause an airtight top portion because the gas pressure within each chamber, especially those farther beneath the surface of the water, will be extremely high. In addition, spacer element 58 is provided to fit against the bottom flange 28.

By severely limiting the capacity of the valve or by the use of a very small orifice and by using very high pressure gas in the conduit, the failure of a valve to close in one or two chambers would not cause all chambers to cease filling with gas. Some gas would simply be discharged at the bottom of the chambers with a valve failure until the other chambers were filled with gas. The overall gas injection rate would not be reduced because many chambers would normally be filling simultaneously even though the chambers nearer the surface fill faster because the water pressure is lower there.

The failure of a single valve to close after all the chambers are filled is also not a significant problem. If the source of compressed gas is no longer delivering gas to the chamber, the water level will rise as gas flows back through the valve. However, the gas above the water is necessarily at the same pressure as the water. Therefore, the water level cannot rise about the valve.

It should be recognized also that if each chamber is partially filled with gas to allow for a certain amount of buoyancy, the chamber will hold that amount of gas and maintain that amount of buoyancy.

When all chambers are full, there will be less buoyancy for the chambers nearer the wellhead because the gas in those chambers is under higher pressure and therefore is heavier per unit volume. There will be no tendency for a more buoyant lower portion of the riser conduit to float to a higher position than the upper portion of the riser conduit. The slightly more buoyant upper chambers have a tendency to maintain the conduit vertically. This limits horizontal movement.

As the buoyancy to the system is increased, the riser can become free-standing to allow the vessel to leave its associated conduit. The top portion should then terminate a sufficient distance below the water level to not become a hazard to navigation. A marker buoy would be attached to the riser to facilitate in relocating it.

Buoyancy means for use with subsea well apparatus have been shown which includes a marine conductor 20 run from a floating vessel to a subsea well and which is formed of conduit sections 21 connected together in an end-to-end relationship. The buoyancy means comprises flange means 29 extending radially outwardly from and about one or more of the plurality of the conduit sections in an airtight relationship thereto. There are a plurality of airtight shells 42 and mounting means 41 for mounting the shells positioned about the one or more of the conduit sections and extending downwardly from the associated flange means to form a plurality of buoyancy chambers 40 which are open at their bottoms. Gas supply means 50 supply selctable amounts of gas from a source on the vessel to each chamber, the introduction of gas into the chambers displacing water therein out through the open bottom of the chambers.

The foregoing has described in detail the system disclosed in the above-mentioned patent to Watkins, the teachings in this patent being incorporated herein by reference.

One improvement over the system disclosed by Watkins in his aforementioned patent is the provision of means to control the introduction of gas from injection line 51 into chambers 40 only when gas line 51 is pressurized to a predetermined pressure. In the exemplary embodiment of the invention, such means includes check valve means 60 between injection line 51 and valve chambers 57. Check valve means 60 includes a passageway 61 extending generally vertically through valve means 52 opening into a laterally extending passageway 62 in valve means 52 which passageway 62 opens into communication with the chamber 63 through which float means 55 extends. Check valve means 64 is disposed in an enlarged section 65 of passageway 62 and includes a spring 67 biasing a ball 66 onto seat 68. In the exemplary embodiment, as will be discussed, valve means 64 is normally closed and adapted to open only when gas supply line 51 is pressurized above a predetermined amount, as for example, at 100 psi.

However , it has been found desirable to make the flotation means disclosed in the Watkins patent completely adjustable. Accordingly, as particularly contemplated in the present invention, gas bleeding off means 69 operable from the vessel 10 are provided for bleeding off gas from within the chambers 40 to reduce the buoyancy thereof.

Figure 2:
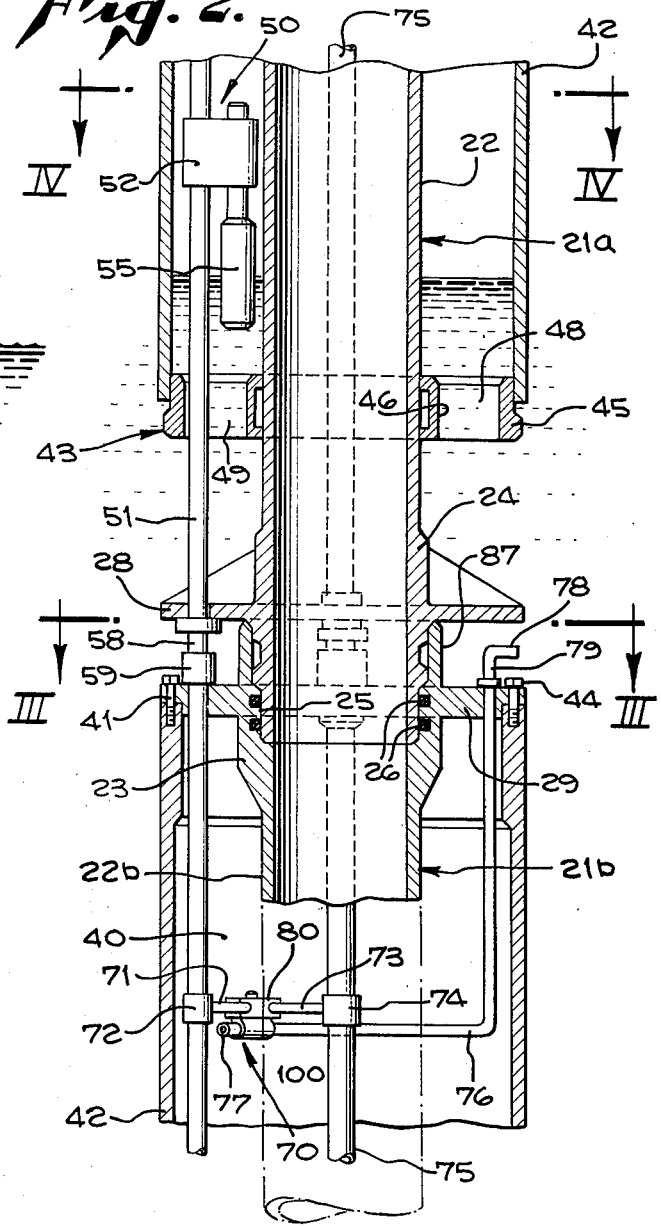
FIG. 2 is a sectional view taken along line II—II of FIG. 1 and shows the bottom portion of one section of the riser conduit connected to the top portion of another section of riser conduit.
Figure 6:
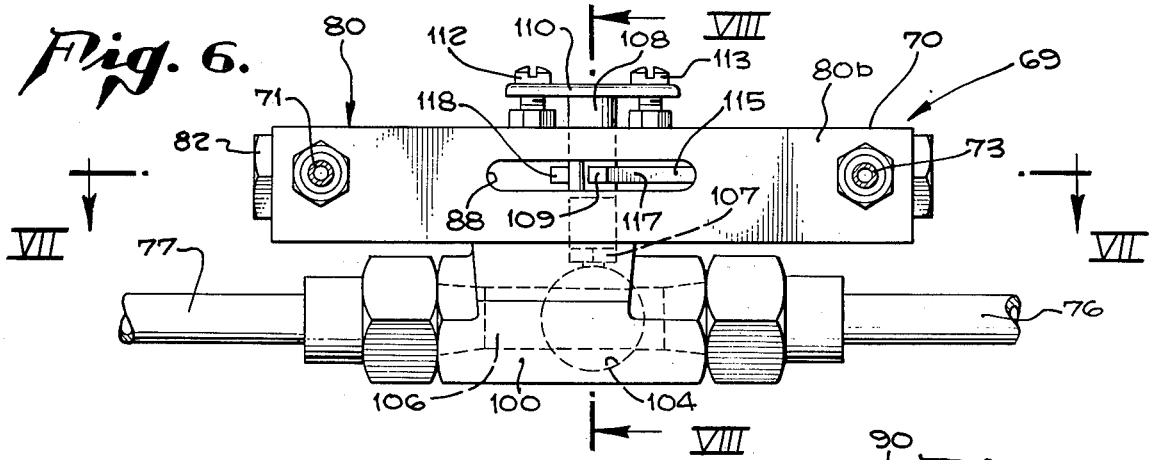
FIG. 6 is a detailed view of the valve per se of FIG. 5.
Figure 7:
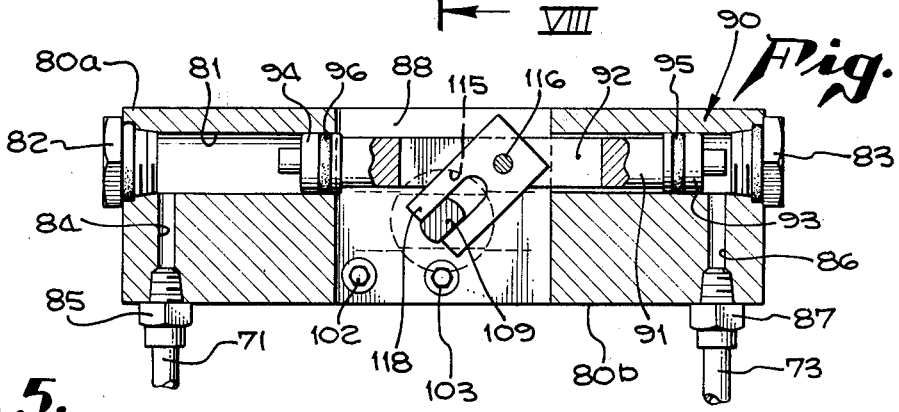
FIG. 7 is a sectional view taken along lines VII—VII of FIG. 6.

In the exemplary embodiment of the invention, such means includes pilot means 70 (see particularly FIGS. 6 and 7) which includes a fluid conduit 71 leading to gas supply line 51 (see also FIG. 2) and is coupled thereto by fluid coupling 72. A fluid conduit 73 also extends from pilot means 70 and is coupled via fluid coupling 74 to a pilot line 75 leading to vessel 10.

A bleed line 76 is disposed in each chamber 40 and terminates in a first end 77 opening into the interior of each chamber 40 (see also FIG. 6) and a second end 78 extending through an airtight fitting 79, disposed in an opening in the top flange 29, and out of each chamber 40 thus opening to the ambient fluid surrounding each chamber 40.

Figure 8:
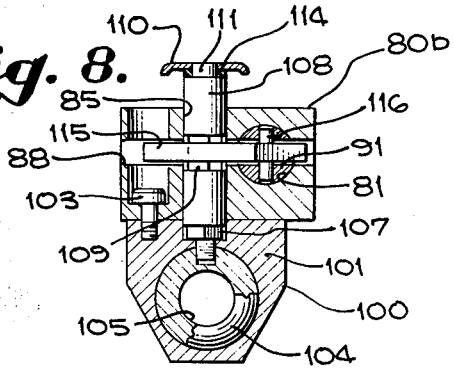
FIG. 8 is a sectional view taken along lines VIII—VIII of FIG. 6.
Figure 4:
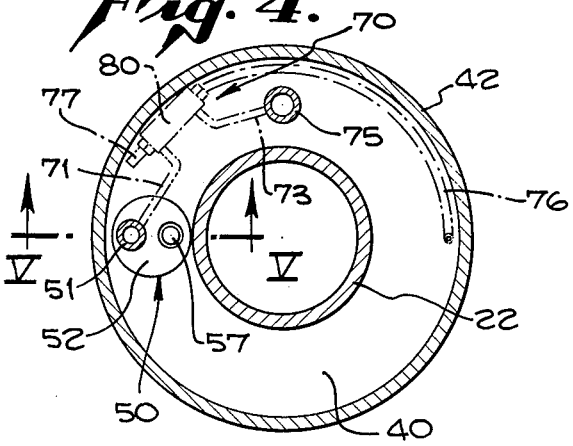
FIG. 4 is a sectional view taken along line IV—IV in FIG. 2.

As particularly contemplated in the present invention, pilot means 70 includes pilot valve means 80 (see particularly FIGS. 6 through 8) for operating pilot means 70 between open and closed positions. In the exemplary embodiment of the invention, such valve means 80 includes piston means **80*a* comprising piston housing 80*b* having a piston chamber 81 (see particularly FIG. 7) plugged at each end by end plugs 82 and 83, extending therethrough. A fluid injection passageway 84 extends through housing 80 transverse to chamber 81 and in fluid communication therewith. The aforementioned conduit 71, coupled to gas conduit means 51, is coupled to passageway 84 by an airtight 85. A passageway 86 is also in fluid communication with chamber 81 and extends transverse thereto. Passageway 86 is coupled, via airtight fitting 87, to fluid conduit 73 which is coupled to pilot line 75 via fluid coupling 74. As clearly shown in FIG. 7, passageways 84 and 86 open into opposite ends of the chamber 81 in housing 80*b*** for reasons to be discussed shortly.

A slot 88 is provided in housing 80 communicating with chamber 81. A vertical bore 89 extends through housing **80*b* and past slot 88 as shown particularly in FIG. 8. A piston 90 is slidably mounted in piston chamber 81 and includes a piston rod 91 having a centrally located slotted portion 92. Piston rod 91 terminates at each end in piston heads 93, 94 slidably engaging the walls of chamber 81. O-ring seals 95 and 96 are provided on piston rod 91 between section 92 and the respective piston head 93, 94.**

As particularly contemplated in the present invention, pilot means 70 also includes means for bleeding off gas from within the chamber 40. Such bleed valve means 100 includes a body portion 101 fixedly secured to pilot housing **80*b* via cap screws 102, 103 (see FIGS. 7 and 8). A ball valve member 104, having a passageway 105 extending therethrough, is disposed in a passageway 106 extending through body portion 101 and generally parallel to chamber 81. (See particularly FIG. 6). A screw 107 is threaded into the top of ball valve member 104 (see particularly FIG. 8) and the head thereof is fixedly secured to a shaft 108 extending through bore 89. Shaft 108 has a rectangular section 109 (see particularly FIG. 7) where it traverses slot 88. Shaft 108 extends out of bore 89 and terminates in a flange member 110 fixedly secured to a stub portion 111 of shaft 108. An O-ring 114 surrounds stub portion 111 and is disposed between the underside of flange member 110 and the upper surface of shaft 108. Bolts 112, 113 (see FIG. 6) rotatably secure flange member 110 to housing 80b.**

A yoke member 115 is movable within the slotted portion 92 of piston rod 91 (see FIGS. 7 and 8) and fixedly secured thereto by a pivot pin 116. The yoke portions 117, 118 of yoke member 115 extend into slot 88 and surround the rectangular section 109 of shaft 108.

In operation, gas is injected into the chambers 40 as discussed both hereinabove and in the aforementioned patent to Watkins. As will be discussed, means operable from the vessel 10 bleeds off gas from within each of the chambers 40 to reduce the buoyancy thereof so as to make the flotation means completely adjustable.

The check valve means 60 provided between the injection line 51 and the valve members 57 associated with each chamber 40 controls the introduction of gas into each chamber 40 from line 51. That is, a predetermined line pressure is required before normally closed ball 66 will move against spring 67 to thereby unseat ball 66 from seat 68 and permit gas to enter each valve chamber 63.

Thus, when the pressure in line 51 is less than a predetermined amount, say 100 psi, ball valve 66 will close off the valve chamber 63. At this time, gas is present in chambers 40 above the valve chamber 63 as discussed hereinabove. When it is desired to bleed off gas from within the top of each chamber 40 and above valve chamber 63, gas may be injected from vessel 10 down pilot line 75.

As gas is injected from the vessel 10 through pilot line 75, the fluid enters fluid conduit 73 (FIG. 7) and through passageway 86 into chamber 81. This moves piston rod 91 to the left in FIG. 7. Rod 91 moves yoke member 115 in a counterclockwise direction in FIG. 7 within slotted portion 92 of piston rod 91. Since section 109 of shaft 108 is embraced by yoke portions 117, 118 of yoke member 115, it turns thus rotating shaft 108 also in a counterclockwise direction in FIG. 7 about its longitudinal axis. Ball valve member 104, which normally blocks passageway 106, is also rotated so that ball passageway 105 if aligned with passageway 106 to permit fluid to pass therethrough. Fluid within each chamber 40 then enter the open end 77 of bleed line 76, which fluid goes through aligned passageways 105, 106, and exits out of end 78 into the ambient ocean surrounding chambers 40. As the fluid exits out of chambers 40, through lines 76, the buoyancy of each chamber is reduced. Thus, when gas pressure in pilot line 75 is greater than the pressure in injection line 51 (the latter pressure being less than a predetermined amount, as, for example, 100 psi), gas from vessel 10 may be used to control the pilot valve means to open the bleed valve means. The pressure of the gas supplied from vessel 10 down pilot line 75 may be controlled at the vessel 10. Althouh the end 78 of bleed line 76 has been disclosed as opening into the ambient fluid surrounding chambers 40, obviously line 76 may extend to vessel 10 with end 78 then opening into the atmosphere surrounding vessel 10. If the pressure in line 51 drops, check valve means 60 will again close and gas will enter conduit 71 to move rod 91 to the right in Fig. 7 to again close off bleed line 76. Thus, the pilot means respond to the difference in pressure between injection line 51 (via line 71 and conduit 84) and pilot line 75 (via line 73 and conduit 86) to selectively open and close the ball valve member 104 of the bleed valve means 100.

Thus, gas pressure within said chambers 40 is reduced by the pilot means 70, the pilot valve means 80 thereof moving piston means 80*a* to open and close the ball valve member 104. Member 104 opens when the injection line pressure is below a predetermined amount and the pressure in pilot line 73 exceeds the pressure in the injection line in an amount sufficient to overcome the resistance of the piston means 80*a* to moving from closed to open position.

In summary, applicants have disclosed improvements in flotation means for a subsea well riser wherein one or more buoyancy chambers are open in the lower portions to the sea and gas is selectively injected therein. The improvements include the provision of means operable from the vessel for bleeding off gas from within each of the chambers for reducing the buoyancy thereof and check valve means for controlling the introduction of gas into each chamber from the gas injection line.

We claim:

1. In a flotation means for a subsea well riser run from a floating vessel to a subsea well and including one or more buoyancy chambers open in lower portions thereof to the sea and means for injecting gas from a source thereof under pressure into each such chamber, such means including a gas injection line run from said vessel to each said chamber, the improvement comprising the provision of:

gas bleeding means operable from said vessel for bleeding off gas from within each of said chambers to reduce the buoyancy thereof;

an injection valve for each of said chambers and operatively connected to said gas injection line, and normally closed check valve means associated with each of said injection valves adapted to open when the pressure of the gas in said injection line is above a predetermined amount to thereby admit gas from said injection line into each said chamber when said gas pressure in said injection line exceeds said predetermined amount; and wherein said gas bleeding means includes pilot means adapted to selectively control the bleeding off of gas from within each of said chambers when the pressure of gas in said injection line is less than a predetermined amount, said pilot means further includes gas bleed valve means having an inlet opening to the interior of each of said chambers and an outlet opening to the exterior thereof, and pilot valve means operatively connected to said gas bleed valve means for operating said gas bleed valve means between open and closed positions and further wherein:

said pilot valve means includes piston means operatively connected to said gas bleed valve means for moving said gas bleed valve means between its open and its closed position and a pilot line operatively connected at one end to a source of gas under controllable pressure at said vessel and at the other end to said piston means.

2. The improvement of flotation means of claim 1 wherein:

said pilot means includes a pilot injection line operatively connected at one end to said gas injection line and at the other end to said piston means.

3. The improvement in flotation means of claim 2 wherein:

said gas bleed valve means and said pilot valve means are located within each of said chambers and said injection and pilot lines are run into said chamber to said piston means to selectively move said piston means to open and close said gas bleed valve means in response to differential pressure between said injection line and said pilot line.

4. The improvement in flotation means of claim 2 wherein:

said pilot valve means includes a yoke member fixedly secured to said piston means and said gas bleed valve means includes a ball member having a passageway extending therethrough, said gas bleed valve means further including a valve body having a passageway therethrough with said ball member disposed in the passageway in said valve body and in sealing contact with the walls of the passageway in said valve body, said yoke member engaging said ball member, and means associated with both said yoke member and said ball member for opening said passageway through said valve body by coaxially aligning the passageway through said ball member with the passageway through said valve body when said piston means moves said yoke member in a first direction and closing said passageway through said valve body by closing off the passageway through said ball member with respect to the passageway through said valve body when said piston means moves said yoke member in a second direction.

5. In a flotation means for a subsea well riser including one or more buoyancy chambers and means including a gas injection line and injection valves for injecting gas from a remote source under pressure into each such chamber to displace water therefrom and thereby increase the buoyancy provided by the chamber, the improvement comprising the provision of:

a gas bleed valve having an inlet opening to the interior of said chamber and an outlet opening to the exterior thereof;

a pilot valve means for operating said gas bleed valve between open and closed positions;

a pilot line run from a remote source of gas under controllable pressure; and conduit means for interconnecting said pilot valve means between said gas injection line and said pilot line for operating said pilot valve means to open or close said gas bleed valve in response to the differential pressure between said injection and pilot lines.

6. The improvement in flotation means of claim 5 wherein said pilot valve means includes a piston chamber having a movable piston therein, said piston being operatively connected to said gas bleed valve and said injection line and said pilot line opening into said piston chamber on opposite sides of said piston.

7. The improvement in flotation means of claim 6 wherein said gas bleed valve and said pilot valve means are located within a buoyancy chamber and said injection and pilot lines are run into said chamber to said pilot valve means.

8. The improvement in flotation means of claim 7 wherein:

a check valve is provided between said injection line and said injection valve.

9. The improvement in flotation means of claim 7 wherein:

said pilot valve means includes a yoke member fixedly secured to said piston and said gas bleed valve includes a ball member having a passageway therethrough, said gas bleed valve further including a valve body having a passageway therethrough with said ball member disposed in the passageway in said valve body and in sealing contact with the walls of the passageway in said valve body, said yoke member engaging said ball member, and means associated with both said yoke member and said ball member for opening said passageway through said valve body by coaxially aligning the passageway through said ball member with the passageway through said valve body when said piston moves said yoke member in a first direction and closing said passageway through said valve body by closing off the passageway through said ball member with respect to the passageway through said valve body when said piston moves said yoke member in a second direction.

10. In a flotation means for a subsea well riser including one or more buoyancy chambers and means including a gas injection line for injecting gas from a remote source under pressure into each such chamber, the improvement comprising the provision of:

a gas bleed line open at one end to an upper portion of the interior of one of said chambers and at an opposite end to the exterior thereof;

a gas bleed valve associated with said gas bleed line for opening and closing the same;

a pilot line run from a source of gas under pressure at said vessel;

a pilot valve means connected across said gas injection line and said pilot line and in fluid communication with both said gas injection line and said pilot line for operating said gas bleed valve to open position when said pilot line pressure exceeds that of said injection line and to close said bleed valve when said pilot line pressure is less than that of said injection line.

11. The improvement in flotation means of claim 10 wherein:

each of said chambers includes an injection valve operatively connected between said gas injection line and said pilot valve means, and normally closed check valve means associated with each of said injection valves adapted to open when the pressure of the gas in said injection is above a predetermined amount, to thereby admit gas from said injection line into each said chamber when said gas pressure in said gas injection line exceeds said predetermined amount.

12. The improvement in flotation means of claim 10 wherein:

said pilot valve means is operatively connected to said gas bleed valve for operating said gas bleed valve between open and closed positions.

13. The improvement in flotation means of claim 12 wherein:

said pilot valve means includes piston means operatively connected to said gas bleed valve for moving said gas bleed valve between its open and its closed position, and said pilot line is operatively connected at one end to a source of gas under controllable pressure at said vessel and at the other end to said piston means.

14. The improvement in flotation means of claim 13 wherein:

said gas bleed valve and said pilot valve means are located within each of said chambers and said injection and pilot lines are run into said chamber to said piston means to selectively move said piston means to open and close said gas bleed valve in response to differential pressure between said gas injection line and said pilot line.

15. In a flotation means for a subsea well riser run from a floating vessel to a subsea well and including one or more buoyancy chambers open in lower portions thereof to the sea and means for injecting gas from a source thereof under pressure into each such chamber, such means including a gas injection line run from said vessel to each said chamber, the improvement comprising the provision of:

injection valve means operable to inject gas into said chamber when line pressure in said gas injection line is above a predetermined amount;

a pilot line connected to a source of pressure; and a pilot operated valve connected between said injection and pilot line and operable in response to differential pressure between said gas injection line and said pilot line; and a gas bleed valve disposed in a bleed line from said chamber, whereby gas pressure within said chamber may be reduced by causing said pilot operated valve to operate said gas bleed valve to open position when said injection line pressure is below said predetermined amount and said pilot pressure exceeds that of said injection line pressure sufficiently to provide a force to overcome the resistance of said pilot operated valve to moving from closed to open position.

16. The improvement in flotation means of claim 15 wherein:

said gas bleed valve includes an inlet opening to the interior of said chamber and an outlet opening to the exterior thereof, and said pilot operated valve is operatively connected to said gas bleed valve for operating said gas bleed valve between open and closed positions.

17. The improvement in flotation means of claim 16 wherein:

piston means is operatively connected to both said pilot operated valve and said gas bleed valve for moving said gas bleed valve between its open and its closed position, and said pilot line is operatively connected at one end to a source of gas under controllable pressure at said vessel and at the other end to said piston means.

18. The improvement in flotation means of claim 17 wherein:

said gas bleed valve and said pilot operated valve and said piston means are located within said chamber and said injection and pilot lines are run into said chamber to said piston means to selectively move said piston means to open and close said gas bleed valve in response to differential pressure between said gas injection line and said pilot line.

19. The improvement in flotation means of claim 18 wherein:

said pilot operated valve includes a yoke member fixedly secured to said piston means and said gas bleed valve includes a ball member having a passageway therethrough, said pilot operated valve further including a valve body having a passageway therethrough with said ball member disposed in the passageway in said valve body and in sealing contact with the walls of the passageway in said valve body, said yoke member engaging said ball member, and means associated with both said yoke member and said ball member for opening said passageway through said valve body by coaxially aligning the passageway through said ball member with the passageway through said valve body when said piston means moves said yoke member in a first direction and closing said passageway through said valve body by closing off the passageway through said ball member with respect to the passageway through said valve body when said piston means moves said yoke member in a second direction.

20. In a flotation means for a subsea well riser run from a floating vessel to a subsea well and including one or more buoyancy chambers open in lower portions thereof to the sea and means for injecting gas from a source thereof under pressure into each such chamber, such means including a gas injection line run from said vessel to each said chamber, the improvement comprising the provision of:

gas bleeding means operable from said vessel for bleeding off gas from within each of said chambers to reduce the buoyancy thereof, said gas bleeding means including a pilot valve means operable in response to differential pressure between the pressure of said injection line and the pressure of a pilot line run from said vessel whereby said gas bleeding means may be operated from said vessel to bleed gas off from within each of said chambers in response to the differential pressure between said gas injection line and said pilot line.

21. A method of bleeding gas from flotation means for a subsea well riser run from a floating vessel to a subsea well which includes one or more buoyancy chambers which receive gas via an injection line run from the floating vessel to each of the chambers comprising the step of:

operating one or more bleed valves connected to one or more of said chambers to an open position in response to a differential pressure of a predetermined amount between said gas injection line and a pilot line run from said vessel.

* * * * *